US011666096B2

(12) United States Patent
Villamar

(10) Patent No.: US 11,666,096 B2
(45) Date of Patent: Jun. 6, 2023

(54) CERAMIC VAPORIZERS WITH EXTERNAL COOLING FINS EXTENDING SUBSTANTIALLY CIRCUMFERENTIALLY AROUND THE ENTIRE SURFACE OF THE VAPORIZER CASE

(71) Applicant: Carlos R. Villamar, Falls Church, VA (US)

(72) Inventor: Carlos R. Villamar, Falls Church, VA (US)

( * ) Notice: Subject to any disclaimer, the term of this patent is extended or adjusted under 35 U.S.C. 154(b) by 122 days.

(21) Appl. No.: 16/824,595

(22) Filed: Mar. 19, 2020

(65) Prior Publication Data

US 2021/0289842 A1 Sep. 23, 2021

(51) Int. Cl.

| | |
|---|---|
| ***A24F 40/46*** | (2020.01) |
| ***A24F 7/00*** | (2006.01) |
| ***A24F 40/57*** | (2020.01) |
| ***A24F 40/51*** | (2020.01) |
| ***A24F 1/02*** | (2006.01) |

(52) U.S. Cl.

CPC ..... *A24F 40/46* (2020.01); *A24F 1/02* (2013.01); *A24F 7/00* (2013.01); *A24F 40/51* (2020.01); *A24F 40/57* (2020.01)

(58) Field of Classification Search

None

See application file for complete search history.

(56) References Cited

U.S. PATENT DOCUMENTS 1,775,947 A 9/1930 Robinson
2006/0096607 A1* 5/2006 Twelftree ..... A24C 5/3406 131/185
2008/0149118 A1* 6/2008 Oglesby ..... A61M 15/06 131/194
2014/0085877 A1* 3/2014 Hao ..... F21L 4/005 362/200
2014/0130811 A1* 5/2014 Touzjian ..... A24F 1/30 131/173

(Continued)

FOREIGN PATENT DOCUMENTS

CA 3039635 A1 * 4/2018 ..... A24F 40/46
WO WO-9748294 A1 * 12/1997 ..... A24F 47/008

(Continued)

OTHER PUBLICATIONS

Evolv_LLC_DNA 250 Color, available on World Wide Web at https://www.evolvapor.com/products/dna250color, printed on Mar. 19, 2020, 7:20 PM.

(Continued)

*Primary Examiner* — Xiao S Zhao

*Assistant Examiner* — Guy F Mongelli

(74) *Attorney, Agent, or Firm* — Carlos R. Villamar; The Villamar Firm PLLC

(57) ABSTRACT

A ceramic vaporizer and atomizer system, method and computer program product, including a ceramic vaporizer case; and a ceramic atomizer removably coupled to the ceramic vaporizer case. The ceramic vaporizer case includes external cooling fins for heat dissipation. The ceramic atomizer includes a mouthpiece portion with external cooling fins for heat dissipation. The ceramic atomizer includes a chamber for housing a heating element and that is configured as an insulator for heat retention.

13 Claims, 3 Drawing Sheets

(56) References Cited

U.S. PATENT DOCUMENTS

| | | | | |
|---|---|---|---|---|
| 2014/0150783 | A1* | 6/2014 | Liu | A24F 40/40 128/202.21 |
| 2014/0182609 | A1* | 7/2014 | Liu | A24F 40/40 131/329 |
| 2014/0253144 | A1* | 9/2014 | Novak, III | A24F 40/40 324/550 |
| 2016/0192708 | A1* | 7/2016 | DeMeritt | H05B 1/0244 131/329 |
| 2016/0309789 | A1* | 10/2016 | Thomas, Jr. | A61M 11/042 |
| 2016/0331036 | A1* | 11/2016 | Cameron | H04Q 9/00 |
| 2017/0112196 | A1* | 4/2017 | Sur | H05B 1/0227 |
| 2017/0127722 | A1* | 5/2017 | Davis | A24F 40/465 |

FOREIGN PATENT DOCUMENTS

| | | | | |
|---|---|---|---|---|
| WO | WO-2013155645 | A1 * | 10/2013 | A24F 47/00 |
| WO | WO-2020029909 | A1 * | 2/2020 | A24F 40/40 |

OTHER PUBLICATIONS

HoneyStick_Plasma_GQ_Vape, available on World Wide Web at https://cannabisvapelife.com/plasma-gq-wax-vaporizer-review/, printed on Mar. 19, 2020, 7:30 PM.

Venus_Apollo_Vaporizer-Vape_Life_Forum, available on World Wide Web at https://forum.vapelife.com/discussion/2048/venus-apollo-vaporizer, printed on Mar. 19, 2020, 7:22 PM.

Heat_Heat_resistance_Characteristics_of_Fine_Ceramics_Fine_Ceramics_World_Kyocera, printed on Mar. 10, 2022; available on the worldwide web at global.kyocera.com/fcworld/charact/heat/heatresist.html.

Heat_Thermal_conductivity_Characteristics_of_Fine_Ceramics_Fine_Ceramics_World_Kyocera, printed on Mar. 10, 2022; available on the worldwide web at global.kyocera.com/fcworld/charact/heat/thermalcond.html#:~t.

* cited by examiner

CERAMIC VAPORIZERS WITH EXTERNAL COOLING FINS EXTENDING SUBSTANTIALLY CIRCUMFERENTIALLY AROUND THE ENTIRE SURFACE OF THE VAPORIZER CASE

BACKGROUND OF THE INVENTION

Field of the Disclosure

The present disclosure generally relates to vaporizer and atomizer systems and methods, and more particularly to systems and methods employing ceramics, halogen bulb, coil and mesh, heating elements, and the like.

Discussion of the Background

In recent years, vaporizer and atomizer systems have been developed to avoid some of the negative effects of cigarette smoking, and the like. However, such systems and methods typically employ open heating elements that can release toxins during vaporization, and can lead to burning due to high heat produced in the atomizer components, and the like.

SUMMARY OF THE DISCLOSURE

Therefore, there is a need for a method and system that addresses the above and other problems. The above and other problems are addressed by the illustrative embodiments of the present disclosure, which provide ceramic vaporizer and atomizer systems and methods employing ceramics, halogen bulb, coil and mesh, heating elements, and the like.

Accordingly, in illustrative aspects of the present disclosure there is provided a ceramic vaporizer and atomizer system, method and computer program product, including a ceramic vaporizer case; and a ceramic atomizer removably coupled to the ceramic vaporizer case. The ceramic vaporizer case includes external cooling fins for heat dissipation. The ceramic atomizer includes a mouthpiece portion with external cooling fins for heat dissipation. The ceramic atomizer includes a chamber for housing a heating element and that is configured as an insulator for heat retention.

The ceramic vaporizer case and the ceramic atomizer are removably coupled via 510 type connectors.

The ceramic vaporizer case and the ceramic atomizer are removably coupled via magnetic type connectors.

The heating element comprises a halogen bulb.

The heating element comprises a wound coil.

The heating element comprises a wire mesh screen coil.

The ceramic atomizer includes a temperature sensor for providing temperate control.

The ceramic vaporizer case includes a vaporizer controller for providing temperate control based on the temperature sensor in the ceramic atomizer.

The ceramic vaporizer case includes a vaporizer controller for providing temperate control based on characteristics of the heating element Still other aspects, features, and advantages of the present disclosure are readily apparent from the following detailed description, by illustrating a number of illustrative embodiments and implementations, including the best mode contemplated for carrying out the present disclosure. The present disclosure is also capable of other and different embodiments, and its several details can be modified in various respects, all without departing from the spirit and scope of the present disclosure. Accordingly, the drawings and descriptions are to be regarded as illustrative in nature, and not as restrictive.

BRIEF DESCRIPTION OF THE DRAWINGS

The embodiments of the present disclosure are illustrated by way of example, and not by way of limitation, in the figures of the accompanying drawings and in which like reference numerals refer to similar elements and in which.

DETAILED DESCRIPTION OF THE PREFERRED EMBODIMENTS

Figure 1:
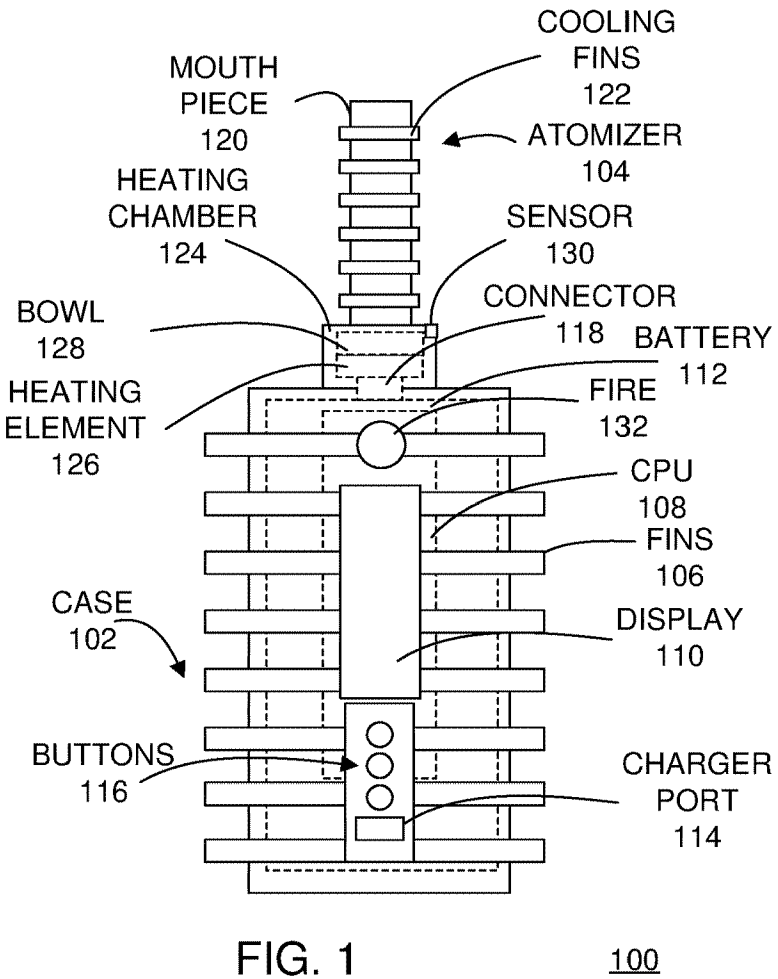
FIG. 1 shows a ceramic vaporizer and atomizer, according to the present disclosure.

Referring now to the drawings, wherein like reference numerals designate identical or corresponding parts throughout the several views, and more particularly to FIG. 1 thereof, there is shown a ceramic vaporizer and atomizer, according to the present disclosure. In FIG. 1, the ceramic vaporizer and atomizer 100 can include a ceramic vaporizer mod case 102 and a ceramic atomizer 104. The ceramic vaporizer mod case 102 has cooling fins 106 for heat dissipation, and connector 118 (e.g., 510 female type connectors, magnetic connectors, etc.) for removably coupling the mod case 102 to the atomizer 104. The mod case 102 is adapted for housing a vaporizer mod box CPU/controller 108 (e.g., Evolv DNA 250 Color controller, etc.), battery 112, and the like, and includes a display 110, charging port 114 (e.g., USB port, etc.), control buttons 116, and a firing button 132 for the mod box controller 108.

The ceramic atomizer 104 includes a mouthpiece 120, cooling fins 122 for heat dissipation, and heating chamber 124 that houses a heating element 126, and a bowl 128 for material to be vaporized (e.g., oils, liquids, concentrates, dry plant matter, etc.), atomized, and the like. The vaporizer mod case 102 and the atomizer 104 can be made of ceramic through 3D printing, casting, molding, and the like. A temperature sensor 130 can be employed in the heating chamber 124 and coupled to the controller 108 for precise temperature control, and the like. Otherwise, the controller 108 can control temperature based on characteristics of the heating element 126, as is well known. Advantageously, the case 102 can be made from a relatively high heat dissipation ceramic material, and the like, for dissipating heat from the battery 112 and the controller 108. The heating chamber 124, advantageously, can be made from a relatively low heat dissipation, insulating ceramic material, and the like, for maintaining heat from the heating element 126 within the heating chamber 124 and to prevent a user from getting burned from the high heat of the heating chamber 124, as compared to conventional atomizers, and the like. The connector 118 conductively couples the ceramic case 102 to the ceramic heating chamber 124 for desired heat conduction, and the like.

Figure 2:
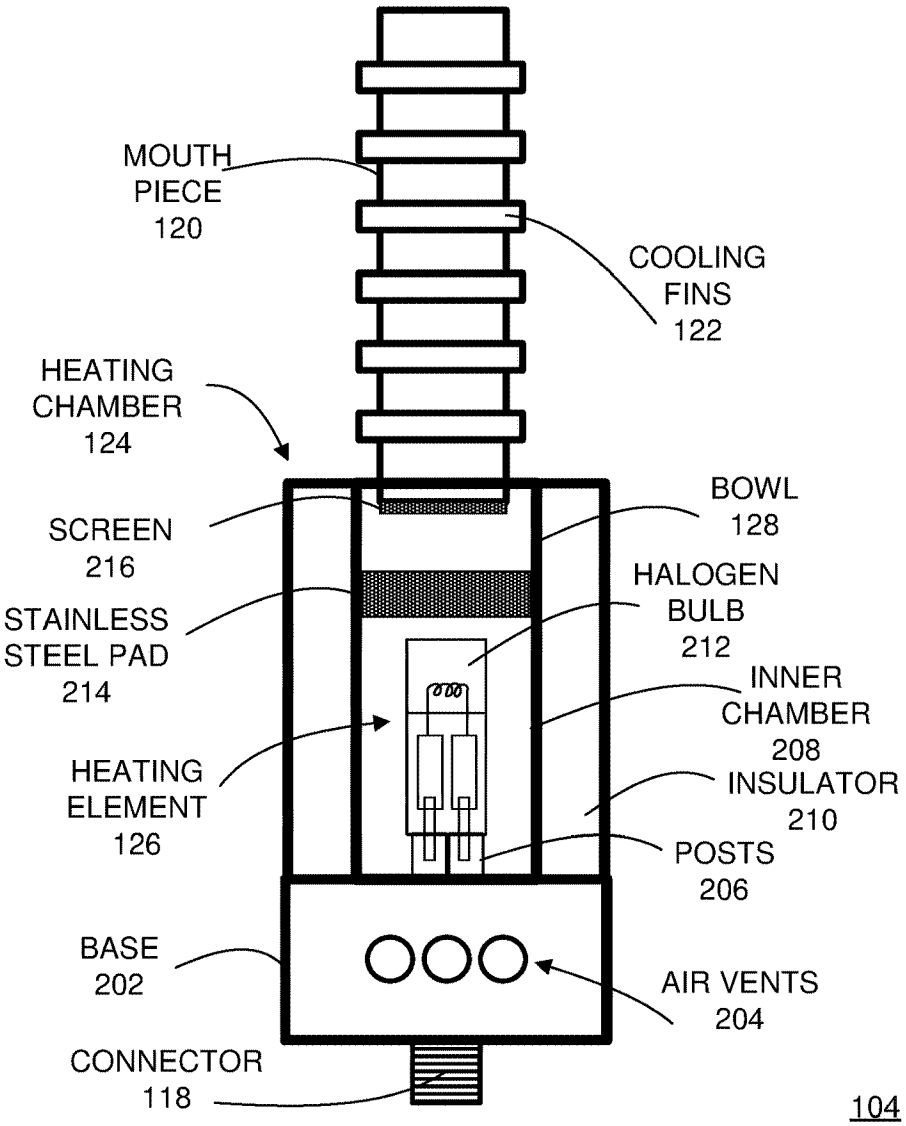
FIG. 2 shows further details of the ceramic atomizer element of FIG. 1 employing a halogen bulb, according to the present disclosure.

FIG. 2 shows further details of the ceramic atomizer element of FIG. 1 employing a halogen bulb, according to the present disclosure. In FIG. 2, the mouthpiece 120 is removably connected to the bowl 128 of an inner chamber 208 (e.g., made from glass, ceramic, etc.) of the ceramic heating chamber 124 made from an insulating material 210 (e.g., ceramic, etc.), and can include a screen 216 to prevent material from entering a mouth of a user. The cooling fins 122, advantageously, cool atomized vapor entering the mouthpiece 120. The heating 126 is configured as a standard halogen bulb 212 (e.g., as used in automobiles, etc.) and being encased in glass, advantageously, prevents toxic metals from entering the heating chamber during vaporization, and the like, is relatively low cost, has a relatively long life cycle, and is relatively cheap to purchase, is capable of extreme heat generation, and the like. A base 202 of the ceramic atomizer 104 can include air intake vent holes 204 for providing air to the heating chamber 124 during drawing in of vapor by a user. Advantageously, the halogen bulb 212 is easy to remove and replace through connection posts 206 that are electrically coupled to the battery 112 and the controller 108 through the connector 118 (e.g., 510 male type connectors, magnetic connectors, etc.). A stainless-steel mesh pad 214 is provide above the halogen bulb 212 for vaporizing material (e.g., oils, liquids, concentrates, dry plant matter, etc.) in the bowl 128.

During operation, a user removes the mouthpiece 120 from the heating chamber 124, places the material to be vaporized onto the mesh pad 214 for vaporizing, and replaces the mouthpiece 120. The user then programs the controller 108 for desired temperature control suitable for the halogen bulb 212 via a menu on the display 110 and the buttons 116. The user then presses the fire button 132 to commence vaporization with desired temperature control. To replace the halogen bulb 212, the user can remove the mouthpiece 120 while coupled to heating chamber 124, along with the inner chamber 208, from the base 202 to expose the halogen bulb 212 for easy replacement.

Advantageously, since the inner chamber 208 can be made from glass, the heating chamber 124 can be removed and the device can function as a flashlight due to the light emitted by halogen bulb 212. Similar, the mouthpiece 120 can be removed and the bowl 128 and pad 214 can be replaced with a small crucible for melting solder and acting as a heated solder well, and the like. The inner chamber 208 can be made from glass of various colors and/or with suitable coating for providing light of various colors, ultraviolet light, and the like, as needed.

Figure 3:
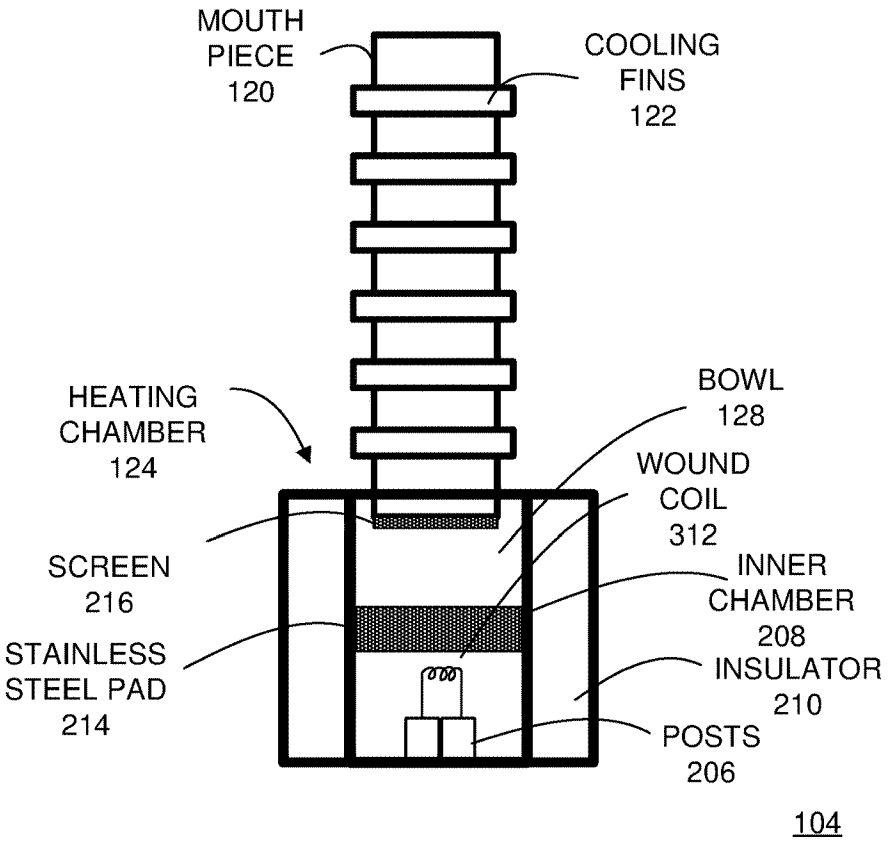
FIG. 3 shows further details of the ceramic atomizer element of FIG. 1 employing a heating coil, according to the present disclosure.

FIG. 3 shows further details of the ceramic atomizer element of FIG. 1 employing a heating coil, according to the present disclosure. In FIG. 3, the operation and design are similar to that of FIG. 2, except that the halogen bulb 212 can be replaced with a conventional, wound heating coil 312, and the like.

Figure 4:
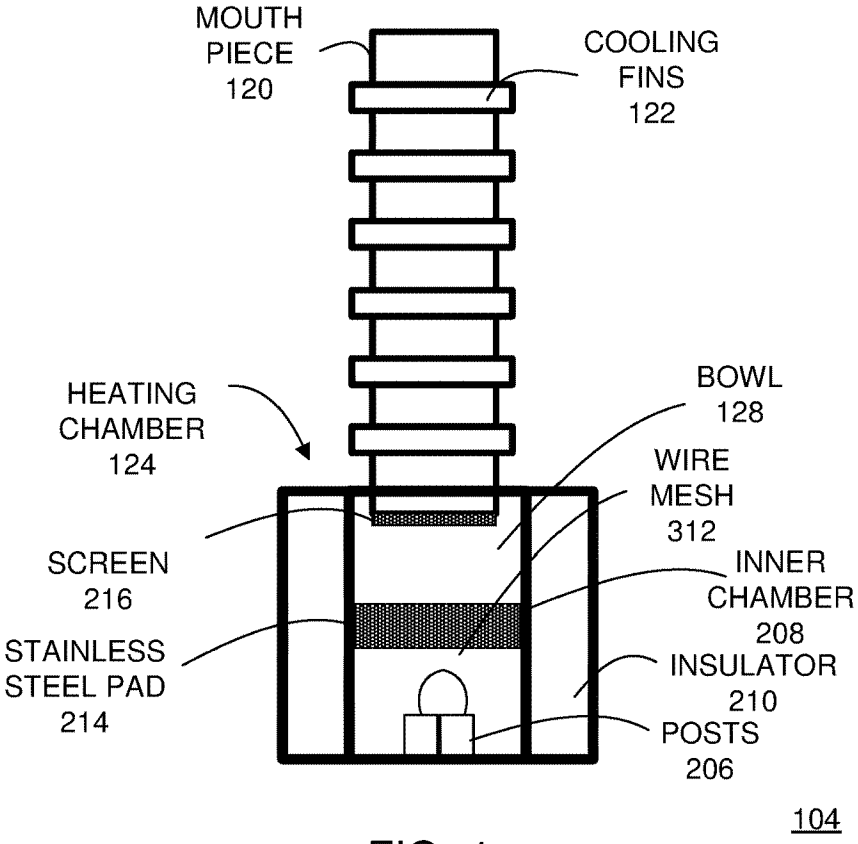
FIG. 4 shows further details of the ceramic atomizer element of FIG. 1 employing a heating mesh, according to the present disclosure.

FIG. 4 shows further details of the ceramic atomizer element of FIG. 1 employing a heating mesh, according to the present disclosure. In FIG. 4, the operation and design are similar to that of FIG. 2, except that the halogen bulb 212 can be replaced with a conventional, wire mesh heating screen 312, and the like.

Figure 5:
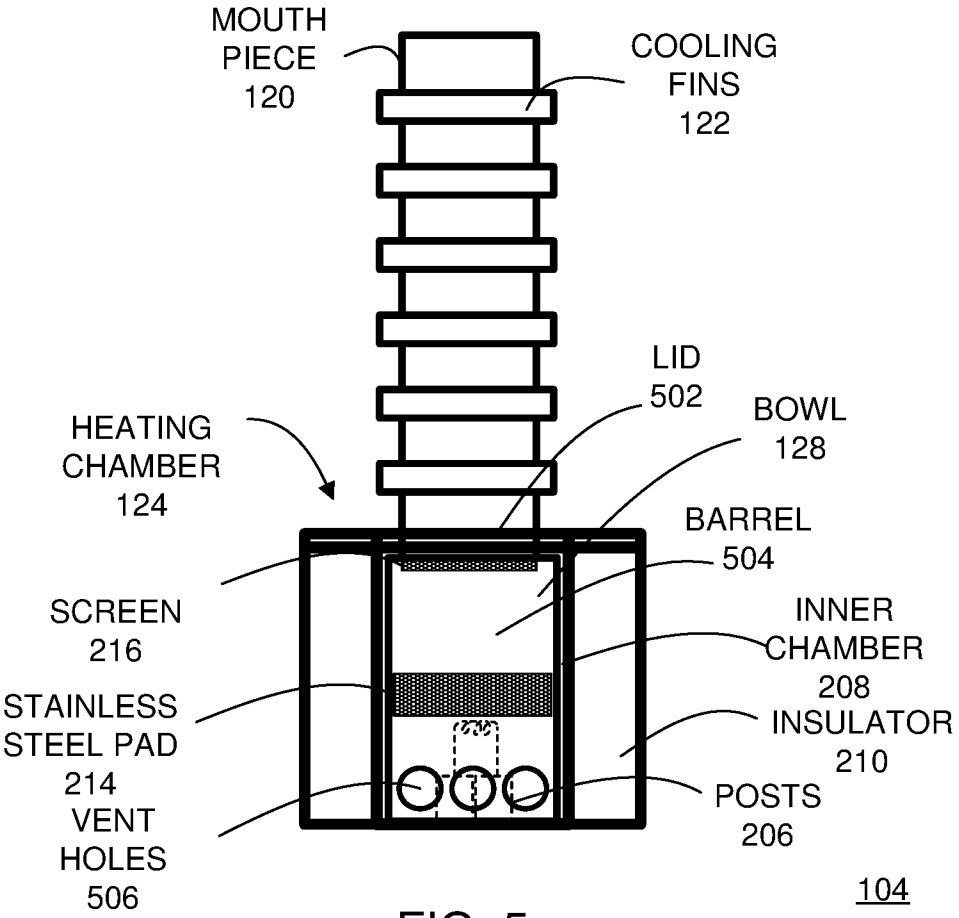
FIG. 5 shows further details of the ceramic atomizer element of FIG. 1 employing an adjustable air intake, according to the present disclosure.

FIG. 5 shows further details of the ceramic atomizer element of FIG. 1 employing an adjustable air intake, according to the present disclosure. In FIG. 5, the operation and design are similar to that of FIGS. 1-4, except that the mouthpiece 120 is removably coupled via a lid 502 to the heating chamber 124. The heating chamber 124 can rotate around a barrel 504 that is provide with vent holes 506 that can match up or not with the vent holes 204 to provide a variable air intake, and the like.

The above-described devices and subsystems of the illustrative embodiments can include, for example, any suitable servers, workstations, PCs, laptop computers, PDAs, Internet appliances, handheld devices, cellular telephones, wireless devices, other devices, and the like, capable of performing the processes of the illustrative embodiments. The devices and subsystems of the illustrative embodiments can communicate with each other using any suitable protocol and can be implemented using one or more programmed computer systems or devices.

One or more interface mechanisms can be used with the illustrative embodiments, including, for example, Internet access, telecommunications in any suitable form (e.g., voice, modem, and the like), wireless communications media, and the like. For example, employed communications networks or links can include one or more wireless communications networks, cellular communications networks, G3 communications networks, Public Switched Telephone Network (PSTNs), Packet Data Networks (PDNs), the Internet, intranets, a combination thereof, and the like.

It is to be understood that the devices and subsystems of the illustrative embodiments are for illustrative purposes, as many variations of the specific hardware used to implement the illustrative embodiments are possible, as will be appreciated by those skilled in the relevant art(s). For example, the functionality of one or more of the devices and subsystems of the illustrative embodiments can be implemented via one or more programmed computer systems or devices.

To implement such variations as well as other variations, a single computer system can be programmed to perform the special purpose functions of one or more of the devices and subsystems of the illustrative embodiments. On the other hand, two or more programmed computer systems or devices can be substituted for any one of the devices and subsystems of the illustrative embodiments. Accordingly, principles and advantages of distributed processing, such as redundancy, replication, and the like, also can be implemented, as desired, to increase the robustness and performance of the devices and subsystems of the illustrative embodiments.

The devices and subsystems of the illustrative embodiments can store information relating to various processes described herein. This information can be stored in one or more memories, such as a hard disk, optical disk, magneto-optical disk, RAM, and the like, of the devices and subsystems of the illustrative embodiments. One or more databases of the devices and subsystems of the illustrative embodiments can store the information used to implement the illustrative embodiments of the present disclosure. The databases can be organized using data structures (e.g., records, tables, arrays, fields, graphs, trees, lists, and the like) included in one or more memories or storage devices listed herein. The processes described with respect to the illustrative embodiments can include appropriate data structures for storing data collected and/or generated by the processes of the devices and subsystems of the illustrative embodiments in one or more databases thereof.

All or a portion of the devices and subsystems of the illustrative embodiments can be conveniently implemented using one or more general purpose computer systems, microprocessors, digital signal processors, micro-controllers, and the like, programmed according to the teachings of the illustrative embodiments of the present disclosure, as will be appreciated by those skilled in the computer and software arts. Appropriate software can be readily prepared by programmers of ordinary skill based on the teachings of the illustrative embodiments, as will be appreciated by those skilled in the software art. Further, the devices and subsystems of the illustrative embodiments can be implemented on the World Wide Web. In addition, the devices and subsystems of the illustrative embodiments can be implemented by the preparation of application-specific integrated circuits or by interconnecting an appropriate network of conventional component circuits, as will be appreciated by those skilled in the electrical art(s). Thus, the illustrative embodiments are not limited to any specific combination of hardware circuitry and/or software.

Stored on any one or on a combination of computer readable media, the illustrative embodiments of the present disclosure can include software for controlling the devices and subsystems of the illustrative embodiments, for driving the devices and subsystems of the illustrative embodiments, for enabling the devices and subsystems of the illustrative embodiments to interact with a human user, and the like. Such software can include, but is not limited to, device drivers, firmware, operating systems, development tools, applications software, and the like. Such computer readable media further can include the computer program product of an embodiment of the present disclosure for performing all or a portion (if processing is distributed) of the processing performed in implementing the disclosure. Computer code devices of the illustrative embodiments of the present disclosure can include any suitable interpretable or executable code mechanism, including but not limited to scripts, interpretable programs, dynamic link libraries (DLLs), Java classes and applets, complete executable programs, Common Object Request Broker Architecture (CORBA) objects, and the like. Moreover, parts of the processing of the illustrative embodiments of the present disclosure can be distributed for better performance, reliability, cost, and the like.

As stated above, the devices and subsystems of the illustrative embodiments can include computer readable medium or memories for holding instructions programmed according to the teachings of the present disclosure and for holding data structures, tables, records, and/or other data described herein. Computer readable medium can include any suitable medium that participates in providing instructions to a processor for execution. Such a medium can take many forms, including but not limited to, non-volatile media, volatile media, transmission media, and the like. Non-volatile media can include, for example, optical or magnetic disks, magneto-optical disks, and the like. Volatile media can include dynamic memories, and the like. Transmission media can include coaxial cables, copper wire, fiber optics, and the like. Transmission media also can take the form of acoustic, optical, electromagnetic waves, and the like, such as those generated during radio frequency (RF) communications, infrared (IR) data communications, and the like. Common forms of computer-readable media can include, for example, a floppy disk, a flexible disk, hard disk, magnetic tape, any other suitable magnetic medium, a CD-ROM, CDRW, DVD, any other suitable optical medium, punch cards, paper tape, optical mark sheets, any other suitable physical medium with patterns of holes or other optically recognizable indicia, a RAM, a PROM, an EPROM, a FLASH-EPROM, any other suitable memory chip or cartridge, a carrier wave or any other suitable medium from which a computer can read.

While the present disclosure have been described in connection with a number of illustrative embodiments, and implementations, the present disclosure is not so limited, but rather cover various modifications, and equivalent arrangements, which fall within the purview of the appended claims.

What is claimed is:

1. A ceramic vaporizer and atomizer system, the system comprising:

a ceramic vaporizer case, including external cooling fins extending over substantially an entire circumferential surface of the vaporizer case, a vaporizer controller with display, a battery for powering the controller and display device, one or more buttons for controlling the computer and display device, and a charging port for charging the battery;

a ceramic atomizer removably coupled to the ceramic vaporizer case, including:

a ceramic mouthpiece portion with external cooling fins extending over substantially an entire circumferential surface of the mouthpiece, and a heat insulating ceramic chamber for housing a heating element comprising a halogen bulb.

2. The system of claim 1, wherein the ceramic vaporizer case and the ceramic atomizer are removably coupled via 510 type connectors.

3. The system of claim 1, wherein the ceramic vaporizer case and the ceramic atomizer are removably coupled via magnetic connectors.

4. The system of claim 1, wherein the ceramic atomizer includes a temperature sensor for providing temperate control.

5. The system of claim 4, wherein the vaporizer controller provides temperate control based on the temperature sensor in the ceramic atomizer.

6. The system of claim 4, wherein the vaporizer provides temperate control based on characteristics of the heating element.

7. The system of claim 1, wherein the ceramic vaporizer case is heat dissipating for providing heat dissipation, the external cooling fins of the ceramic vaporizer case are heat dissipating for providing heat dissipation, the ceramic mouthpiece portion of the ceramic atomizer is heat dissipating for providing heat dissipation;

the external cooling fins of the mouthpiece portion are heat dissipating for providing heat dissipation;

the ceramic chamber is heat insulating for providing heat retention.

8. A ceramic vaporizer comprising:

a ceramic vaporizer case configured to be grasped by a user, in use, comprising:

a ceramic external wall portion extending around an internal heating chamber, wherein the ceramic external wall portion comprises a first longitudinal end portion and a second longitudinal end portion, the ceramic vaporizer case extending along a longitudinal direction from the first longitudinal end portion to the second longitudinal end portion;

a bowl portion configured to receive material to be vaporized;

a first air intake vent hole extending through the ceramic external wall portion and into the internal heating chamber, the first intake air vent hole being configured to allow air from outside the ceramic vaporizer case to flow through the internal heating chamber and through the bowl portion, in use, wherein the first air intake vent hole is positioned at the first longitudinal end portion and the bowl portion is positioned at the second longitudinal end portion;

a heating element positioned in the internal heating chamber and configured to heat air from the first air intake vent hole, in use;

a temperature sensor configured to detect a temperature of air in the internal heating chamber;

a battery;

a first control button mounted on an external surface portion of the external wall portion;

a controller connected to the battery, the first control button, the heating element, and the temperature sensor, the controller configured to activate the heating element with power from the battery in response to activation of the first control button and the temperature sensor; and wherein the external wall portion comprises a first plurality of ceramic cooling fins forming an outermost surface portion of the ceramic vaporizer case, the first plurality of ceramic cooling fins extending transverse to the longitudinal direction of the ceramic vaporizer case and extending over substantially an entire circumferential surface of the vaporizer case; and a ceramic mouthpiece configured to connect to the ceramic vaporizer case and to allow a user to draw air through the first air intake vent hole, into the heating chamber, through the bowl so as to vaporize material contained in the bowl, then into their mouth, in use, the ceramic mouthpiece comprising;

a first intake end portion and a second outlet end portion, wherein the ceramic mouthpiece extends from the first intake end portion to the second outlet end portion along a mouthpiece longitudinal direction, the first intake end portion being configured to connect to the second longitudinal end portion of the ceramic vaporizer case;

a screen positioned at the first intake end portion and configured to contain material to be vaporized within the bowl portion when the first intake end portion is connected to the second longitudinal end portion of the ceramic vaporizer case, and wherein material to be vaporized can be inserted into the bowl portion when the first intake end portion is removed from the second longitudinal end portion; and a second plurality of ceramic cooling fins forming an outermost surface portion of the ceramic mouthpiece, the second plurality of ceramic cooling fins extending transverse to the mouthpiece longitudinal direction and parallel to the first plurality of cooling fins when the ceramic mouthpiece is connected to the ceramic vaporizer case.

9. A ceramic vaporizer comprising:

a ceramic vaporizer case comprising:

a ceramic external wall portion extending around an internal heating chamber, wherein the ceramic external wall portion comprises a first longitudinal end portion and a second longitudinal end portion, the ceramic vaporizer case extending along a longitudinal direction from the first longitudinal end portion to the second longitudinal end portion;

a bowl portion configured to receive material to be vaporized;

a first air intake vent hole extending through the ceramic external wall portion and into the internal heating chamber, the first intake air vent hole being configured to allow air from outside the ceramic vaporizer case to flow through the internal heating chamber and through the bowl portion, in use;

a heating element positioned in the internal heating chamber and configured to heat air from the first air intake vent hole, in use;

a temperature sensor configured to detect a temperature of air in the internal heating chamber;

a battery;

a first control button mounted on an external surface portion of the external wall portion;

a controller connected to the battery, the first control button, the heating element, and the temperature sensor, the controller configured to activate the heating element with power from the battery in response to activation of the first control button and the temperature sensor; and wherein the external wall portion comprises a first plurality of ceramic cooling fins forming an outermost surface portion of the ceramic vaporizer case and extending over substantially an entire circumferential surface of the vaporizer case; and a ceramic mouthpiece configured to connect to the ceramic vaporizer case and to allow a user to draw air through the first air intake vent hole, into the heating chamber, through the bowl so as to vaporize material contained in the bowl, then into their mouth, in use, the ceramic mouthpiece comprising;

a first intake end portion and a second outlet end portion, the first intake end portion being configured to connect to the second longitudinal end portion of the ceramic vaporizer case;

a screen positioned at the first intake end portion and configured to contain material to be vaporized within the bowl portion when the first intake end portion is connected to the second longitudinal end portion of the ceramic vaporizer case, and wherein material to be vaporized can be inserted into the bowl portion when the first intake end portion is removed from the second longitudinal end portion; and a second plurality of ceramic cooling fins forming an outermost surface portion of the ceramic mouthpiece.

10. The ceramic vaporizer of claim 9, wherein the first air intake vent hole is positioned at the first longitudinal end portion and the bowl portion is positioned at the second longitudinal end portion.

11. The ceramic vaporizer of claim 9, wherein the first plurality of ceramic cooling fins extend transverse to the longitudinal direction of the ceramic vaporizer case.

12. The ceramic vaporizer of claim 9, wherein the ceramic mouthpiece extends from the first intake end portion to the second outlet end portion along a mouthpiece longitudinal direction.

13. The ceramic vaporizer of claim 12, wherein the second plurality of ceramic cooling fins extend transverse to the mouthpiece longitudinal direction and parallel to the first plurality of cooling fins when the ceramic mouthpiece is connected to the ceramic vaporizer case.

* * * * *